US012398917B2

(12) United States Patent
Aly et al.

(10) Patent No.: US 12,398,917 B2
(45) Date of Patent: Aug. 26, 2025

(54) HEAT EXCHANGER FOR HVAC SYSTEM

(71) Applicant: Johnson Controls Tyco IP Holdings LLP, Milwaukee, WI (US)

(72) Inventors: Amr Maher Abdellati Aly, Wichita, KS (US); Xianjin Cheng, Andover, KS (US); Cole Brennan Morrow, Derby, KS (US); Elmer Wayne Romero, Oxford, KS (US); Stephen Szczepanski, Wichita, KS (US)

(73) Assignee: Johnson Controls Light Commercial IP GmbH, Neuhausen am Rheinfall (CH)

( * ) Notice: Subject to any disclaimer, the term of this patent is extended or adjusted under 35 U.S.C. 154(b) by 487 days.

(21) Appl. No.: 17/837,298

(22) Filed: Jun. 10, 2022

(65) Prior Publication Data

US 2023/0400222 A1 Dec. 14, 2023

(51) Int. Cl.

| | |
|---|---|
| ***F24F 13/30*** | (2006.01) |
| ***F24F 1/0067*** | (2019.01) |
| ***F24F 13/20*** | (2006.01) |
| ***F24F 13/22*** | (2006.01) |
| ***F28D 1/047*** | (2006.01) |
| ***F28D 21/00*** | (2006.01) |

(52) U.S. Cl.

CPC ..... *F24F 13/30* (2013.01); *F24F 1/0067* (2019.02); *F24F 13/20* (2013.01); *F24F 13/222* (2013.01); *F28D 1/0477* (2013.01); *F28D 2021/0071* (2013.01)

(58) Field of Classification Search

CPC ..... F24F 13/30; F24F 13/20; F24F 13/222; F28D 1/0477; F28D 2021/0071

See application file for complete search history.

(56) References Cited

U.S. PATENT DOCUMENTS

| | | | | |
|---|---|---|---|---|
| 4,546,820 | A * | 10/1985 | Whipple | F28D 1/0435 165/77 |
| 2022/0011010 | A1* | 1/2022 | Silva | F24F 13/029 |
| 2023/0093227 | A1* | 3/2023 | Chapin | F25B 39/02 62/291 |
| 2023/0152012 | A1* | 5/2023 | Dong | F28F 9/26 62/159 |

FOREIGN PATENT DOCUMENTS

| | | |
|---|---|---|
| EP | 1597527 B1 | 6/2011 |

* cited by examiner

*Primary Examiner* — Jerry-Daryl Fletcher
*Assistant Examiner* — Keith Stanley Myers
(74) *Attorney, Agent, or Firm* — Fletcher Yoder, P.C.

(57) ABSTRACT

A heat exchanger for a heating, ventilation, and/or air conditioning (HVAC) system includes a plurality of tubes configured to direct a working fluid therethrough and defining a first section and a second section of the heat exchanger. The first section and the second section extend crosswise relative to one another. The heat exchanger also includes an end sheet coupled to an end of the first section. The end sheet includes a flange extending toward the second section.

20 Claims, 10 Drawing Sheets

HEAT EXCHANGER FOR HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties by conditioning a supply air flow delivered to the environment. For example, the HVAC system may include a heat exchanger configured to place the supply air flow in a heat exchange relationship with a working fluid (e.g., a refrigerant) of a vapor compression system to condition the supply air flow. It may be desirable to limit a physical footprint occupied by the heat exchanger. For example, reducing the physical footprint associated with the heat exchanger may increase efficient usage of space and/or facilitate ease of transportation of the heat exchanger.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heat exchanger for a heating, ventilation, and/or air conditioning (HVAC) system includes a plurality of tubes configured to direct a working fluid therethrough and defining a first section and a second section of the heat exchanger. The first section and the second section extend crosswise relative to one another. The heat exchanger also includes an end sheet coupled to an end of the first section. The end sheet has a flange extending toward the second section.

In one embodiment, a heat exchanger for a heating, ventilation, and/or air conditioning (HVAC) system includes a plurality of tubes configured to direct a working fluid therethrough. The plurality of tubes defines a first panel section, a second panel section, and an intermediate section extending between the first panel section and the second panel section, and the first panel section and the second panel section are configured to rotate relative to one another about the intermediate section. The heat exchanger also includes an end sheet coupled to the first panel section. The end sheet has a flange extending between the first panel section and the second panel section In one embodiment, a heat exchanger for a heating, ventilation, and/or air conditioning (HVAC) system includes a plurality of tubes configured to direct a working fluid therethrough, a first section having a first portion of the plurality of tubes, and a second section having a second portion of the plurality of tubes. The first section includes a first end sheet extending along a first direction of working fluid flow through the first portion of the plurality of tubes, the first end sheet includes a first flange, the second section includes a second end sheet extending along a second direction of working fluid flow through the second portion of the plurality of tubes, the second end sheet includes a second flange, and the first flange and the second flange extend toward one another

DESCRIPTION OF DRAWINGS

Various aspects of this disclosure may be better understood upon reading the following detailed description and upon reference to the drawings in which.

DETAILED DESCRIPTION

Figure 1:
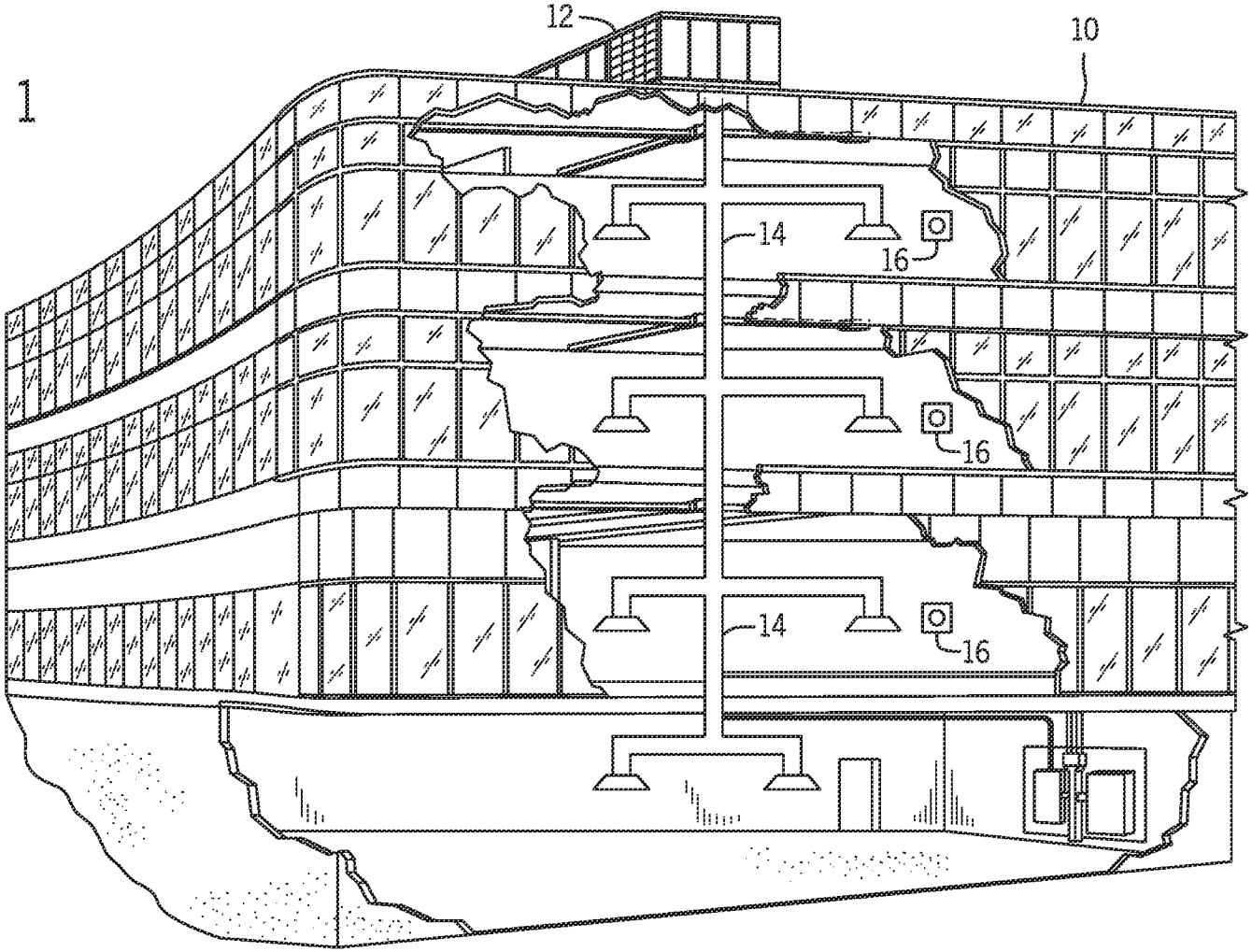
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may be configured to condition (e.g., heat, cool) an air flow and deliver the conditioned air flow to a space, such as a room, to condition the space. For example, the HVAC system may include a heat exchanger configured to place the air flow in a heat exchange relationship with a working fluid, such as a refrigerant, to change a temperature of the air flow. The air flow may then be delivered to the space as a supply air flow to adjust the temperature of the space, such as toward a target or set point temperature of the space.

Existing or conventional heat exchangers may occupy an undesirable (e.g., large) physical footprint. As an example, a heat exchanger may have a shape, a geometry, or other features that increase a space or volume occupied by the heat exchanger. Thus, the heat exchanger may reduce efficient usage of space, such as a space within an enclosure of an HVAC system, a transportation space, and/or a storage space. As a result, certain operations or services, such as installation, transportation, and/or storage of the heat exchanger, may be difficult to perform.

Thus, it is presently recognized that limiting the physical footprint of the heat exchanger may improve performance of various operations related to the heat exchanger. Accordingly, embodiments of the present disclosure are directed to a heat exchanger that includes features for limiting the space occupied by the heat exchanger. For example, the heat exchanger includes tubes through which a working fluid may flow. The tubes may define a first section of the heat exchanger and a second section of the heat exchanger. A first end sheet may be coupled to the first section, and a second end sheet may be coupled to the second section. For instance, the first end sheet may extend along a direction of flow of working fluid through the tubes in the first section, and the second end sheet may extend along a direction of flow of working fluid through the tubes in the second section. The first end sheet and the second end sheet may be configured to couple to a plate. As an example, the plate may block undesirable air flow out of an area between the first section and the second section of the heat exchanger, thereby increasing an efficiency of the heat exchanger to transfer heat between the air flow and working fluid via air flow across the tubes. The first end sheet may include a first flange, the second end sheet may include a second flange, and the plate may be configured to couple to the first end sheet via the first flange and to the second end sheet via the second flange. The first flange and the second flange may extend toward one another, such as toward a space or area formed between the first section and the second section. Thus, the first flange and the second flange may not increase a dimension or size of an outer boundary associated with the heat exchanger (e.g., surrounding a perimeter of the sections of the heat exchanger). In this manner, the flanges enable the heat exchanger to couple to the plate while limiting the physical footprint occupied by the heat exchanger. Thus, the space in which the heat exchanger is disposed may be efficiently utilized.

In certain embodiments, the first section and the second section may be configured to move (e.g., rotate) relative to one another. For example, the first section and the second section may be configured to move toward one another to transition the heat exchanger to a compact configuration, and the first section and the second section may be configured to move away from one another to transition the heat exchanger to an expanded configuration. Additionally, a first notch may be formed in the first end sheet and a second notch may be formed in the second end sheet. The first notch may be configured to receive the second flange of the second end sheet, and the second notch may be configured to receive the first flange of the first end sheet in the compact configuration. As an example, the first notch may enable the second flange of the second end sheet to overlap with the first section, and the second notch may enable the first flange of the first end sheet to overlap with the second section. Thus, the notches may block the first flange from contacting the second end sheet and/or the second flange from contacting the first end sheet in a manner that would limit or block movement of the first section and the second section toward one another to transition the heat exchanger to the compact configuration. Accordingly, the notches may enable a desirable range of movement of the first section and the second section of the heat exchanger (e.g., to enable transition to the compact configuration).

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
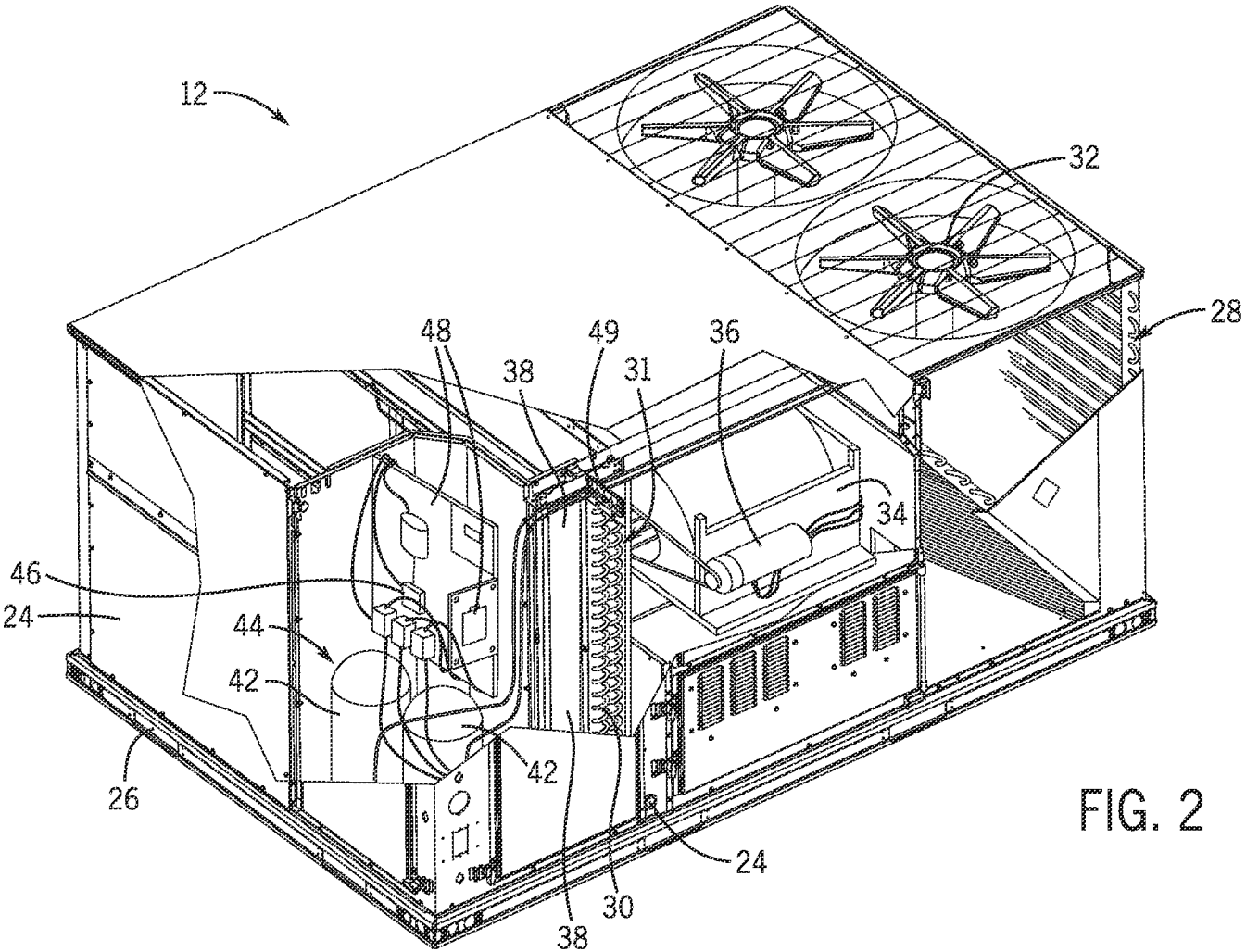
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
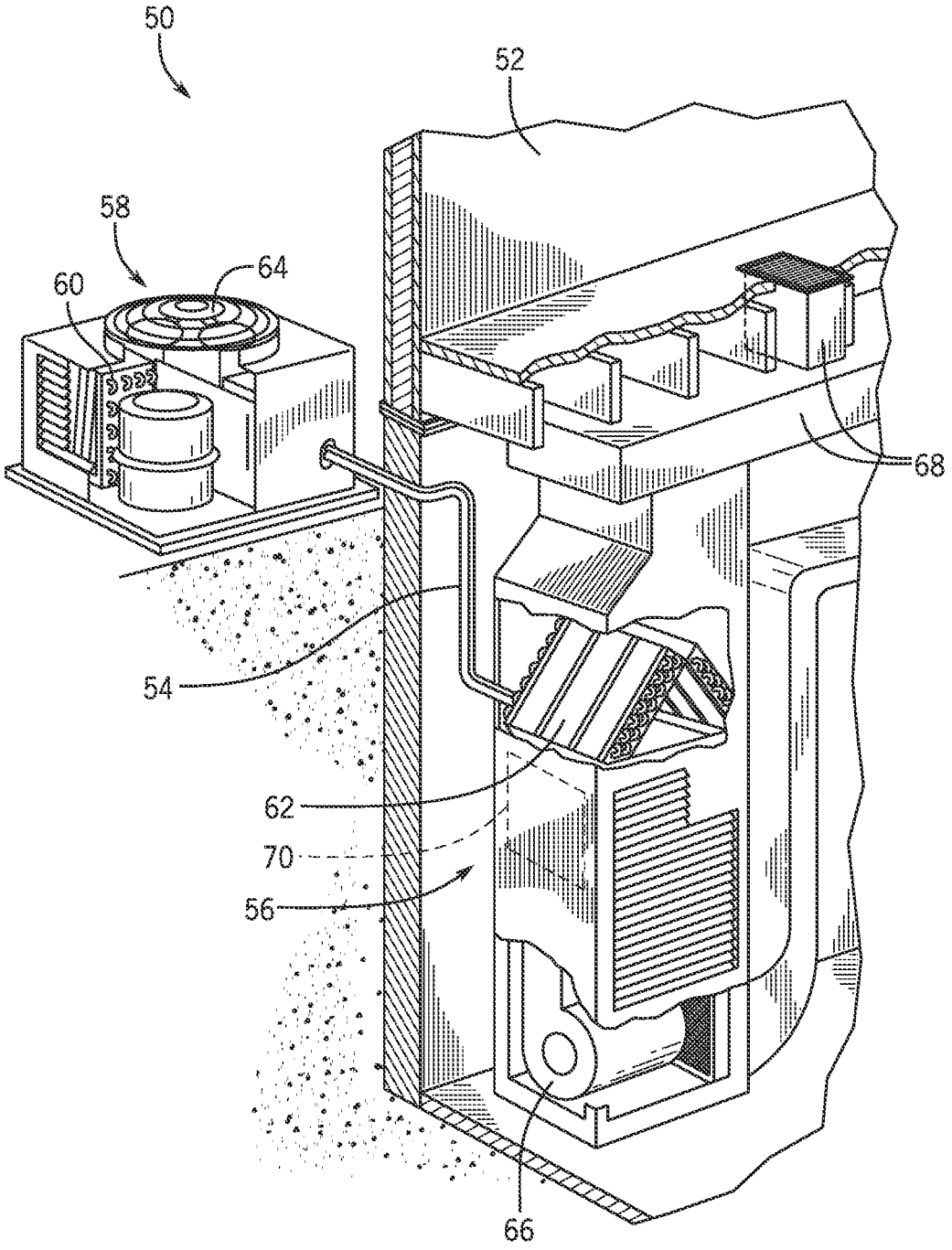
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
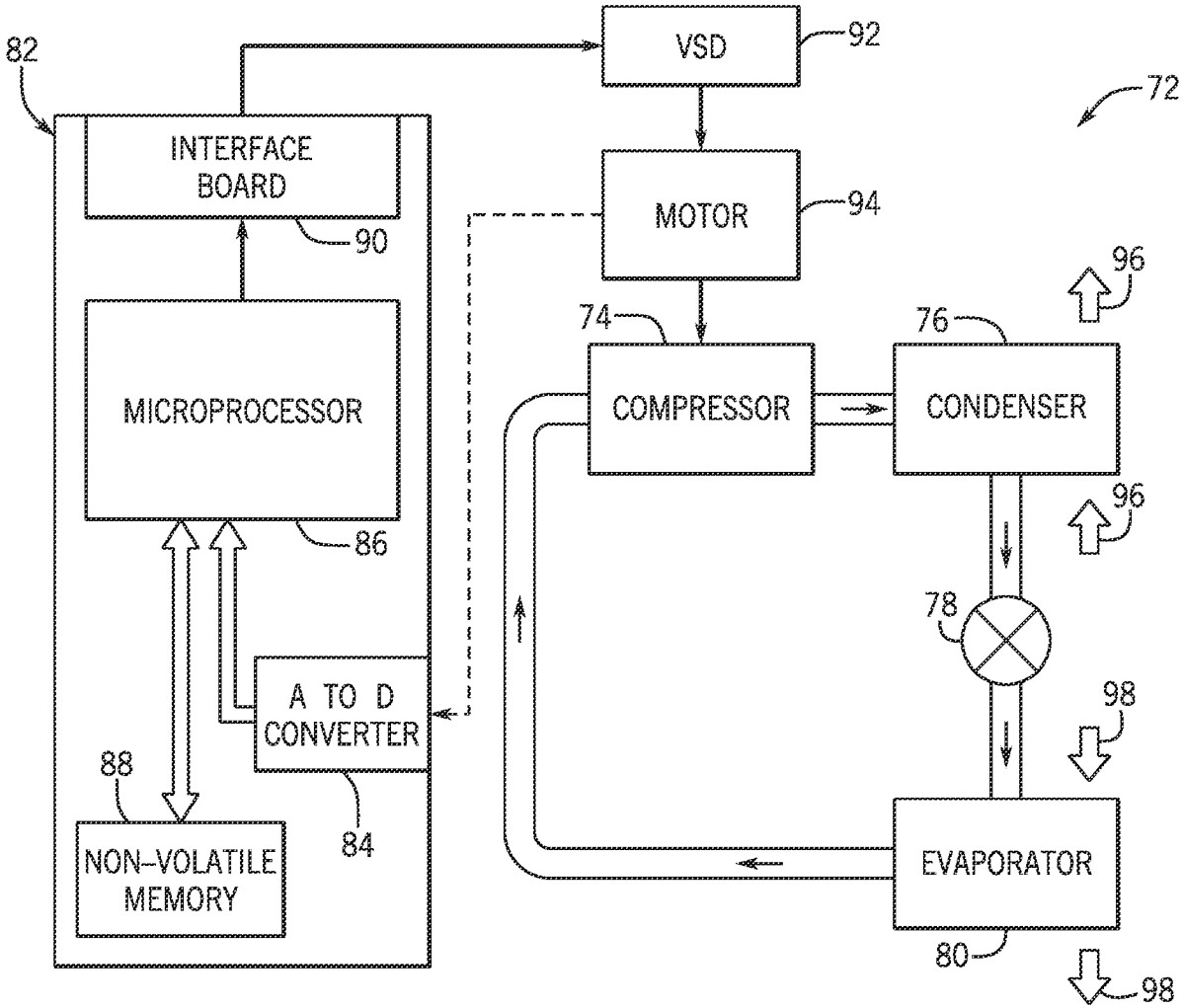
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a heat exchanger that has tubes defining a first section and a second section. A first end sheet may be coupled to the first section, and a second end sheet may be coupled to the second section. The first end sheet may include a first flange, the second end sheet may include a second flange, and a plate may be configured to couple to the first end sheet and the second end sheet via the first flange and the second flange, respectively. For example, the plate may engage with the flanges, and fasteners may be inserted through the plate and the flanges to bias the plate against the end sheets, thereby securing the plate to the first section and the second section of the heat exchanger. The first flange may extend toward the second end sheet, and the second flange may extend toward the first end sheet. Thus, the flanges may extend inwardly from the first and second sections and do not increase an outer boundary defined by an outer perimeter of the heat exchanger (e.g., of the first and second sections). As such, the flanges may enable a reduced physical footprint occupied by the heat exchanger.

Figure 5:
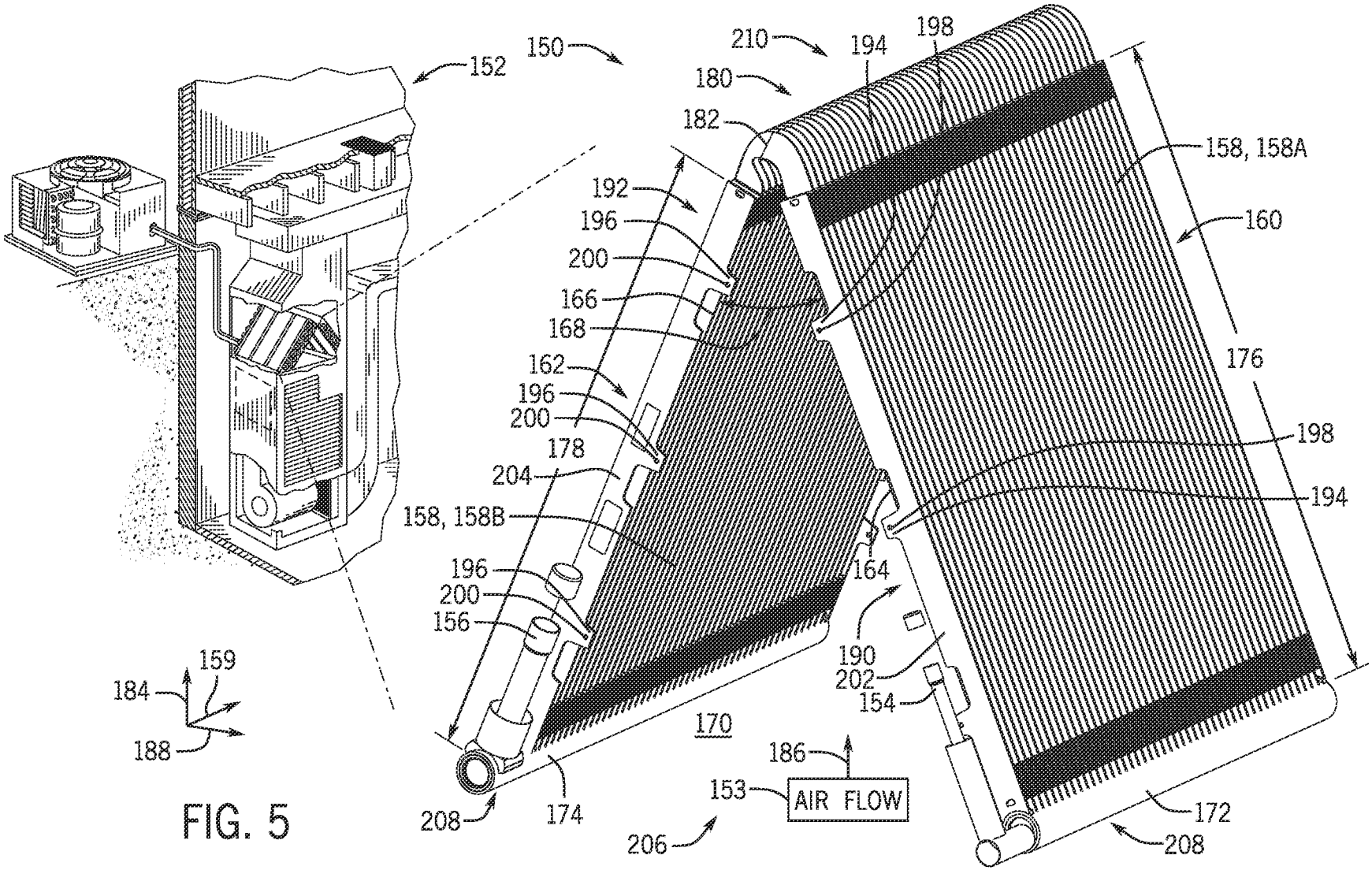
FIG. 5 is a perspective view of an embodiment of a heat exchanger for an HVAC system, in accordance with an aspect of the present disclosure.

With this in mind, FIG. 5 is a perspective view of an embodiment of a heat exchanger 150 (e.g., a heat exchanger assembly) for an HVAC system 152, which may include the HVAC unit 12, the residential heating and cooling system 50, or any other suitable HVAC system. An air flow 153 may be directed across the heat exchanger 150, and a working fluid (e.g., a refrigerant) may be directed through the heat exchanger 150 during operation of the HVAC system 152. For example, the heat exchanger 150 may include an inlet 154 through which the working fluid may be directed into the heat exchanger 150, and the heat exchanger 150 may include an outlet 156 through which the working fluid may be discharged from the heat exchanger 150. The heat exchanger 150 may further include tubes, coils, or channels 158 that direct working fluid from the inlet 154 to the outlet 156. Thus, the working fluid may flow through the heat exchanger 150 by flowing into the inlet 154, through the tubes 158, and out of the outlet 156. In some embodiments, the tubes 158 may include microchannel tubes, but the tubes 158 may include any suitable tubes in additional or alternative embodiments to direct working fluid therethrough.

The air flow 153 (e.g., a supply air flow, a return air flow, an ambient air flow) may be directed across the tubes 158 during operation of the heat exchanger 150. The tubes 158 may enable heat transfer between the air flow 153 directed across the tubes 158 and the working fluid flowing through the tubes 158, thereby changing the temperature of the air flow 153. As an example, heat may transfer from the air flow 153 to the tubes 158 and to the working fluid, thereby cooling the air flow 153 and heating the working fluid. As another example, heat may transfer from the working fluid to the tubes 158 and to the air flow 153, thereby heating the air flow 153 and cooling the working fluid. Additionally, each tube 158 may be offset from one another along a first axis 159 to form spaces between adjacent tubes 158 to enable the air flow 153 to be directed through the heat exchanger 150 and across the tubes 158 via the spaces. For example, the air flow 153 may be directed from the heat exchanger 150 to a space serviced by the HVAC system 152 to condition the space. Furthermore, the working fluid may be directed from the heat exchanger 150 to another component of the HVAC system 152, such as to a compressor (e.g., the compressor 42, the compressor 74), to circulate through a vapor compression system of the HVAC system 152.

The illustrated heat exchanger 150 includes a first section 160 (e.g., a first panel section, a first slab) and a second section 162 (e.g., a second panel section, a second slab) defined by the tubes 158 (e.g., microchannel tubes). The first section 160 and the second section 162 may be positioned crosswise to one another. For example, each of the sections 160, 162 may have a planar or flat (e.g., a rectangular) geometry. The first section 160 may have a first edge 164 (e.g., of one of the tubes 158), the second section 162 may have a second edge 166 (e.g., of the same tube 158 having the first edge 164, of a different tube 158), and the sections 160, 162 may be oriented to form an angle 168 (e.g., an acute angle) between the first edge 164 and the second edge 162. As such, the first section 160 and the second section 162 may be crosswise to one another to form a V-shape or A-shape configuration defining a space or channel 170 between the first section 160 and the second section 162. Each section 160, 162 may include a portion of the tubes 158 (e.g., a portion of each of the tubes 158). For example, the first section 160 may include a first tube portion 158A (e.g., a first portion or length of each tube), and the second section 162 may include a second tube portion 158B (e.g., a second portion or length of each tube). Working fluid may flow through each of the first tube portion 158A and the second tube portion 158B.

The heat exchanger 150 may include a first manifold 172 (e.g., an inlet manifold) that may fluidly couple the inlet 154 to the tubes 158, and the heat exchanger 150 may include a second manifold 174 that may fluidly couple the outlet 156 to the tubes 158. For example, the first manifold 172 may receive the working fluid from the inlet 154 and direct the fluid to each of the tubes 158 (e.g., the first tube portion 158A) at the first section 160, and the second manifold 174 may receive the working fluid from each of the tubes 158 (e.g., the second tube portion 158B) at the second section 162 and discharge the working fluid via the outlet 156. In certain embodiments, the heat exchanger 150 may include more than two manifolds. For example, the heat exchanger 150 may include multiple inlets 154 and/or multiple outlets 156, and the tubes 158 may be coupled to each inlet 154 and outlet 156 via a different manifold.

Each tube 158 may extend from the first manifold 172 to the second manifold 174. That is, each tube 158 may extend along a first dimension 176 (e.g., a first length, a first width) of the first section 160 and also along a second dimension 178 (e.g., a second length, a second width) of the second section 162. Thus, each individual tube 158 may be a part of the first tube portion 158A and the second tube portion 158B, and each tube 158 may direct working fluid flow from first section 160 to the second section 162. In certain embodiments, the working fluid may flow multiple times across the first section 160 and/or the second section 162 (e.g., along the dimensions 176, 178) before being discharged from the heat exchanger 150. For example, the working fluid may flow through one of the tubes 158 from the first section 160 to the second section 162, then along another one of the tubes 158 from the second section 162 to the first section 160, and subsequently along yet another one of the tubes 158 from the first section 160 to the second section 162 toward the outlet 156. In this manner, the working fluid may flow through multiple passes of the heat exchanger 150, and sets of the tubes 158 may be positioned in series with one another with respect to the flow of working fluid through the tubes 158. Additionally or alternatively, working fluid may flow in parallel through sets of the tubes 158. By way of example, working fluid may flow through the inlet 154 and split or divide into multiple working fluid flows within the first manifold 172 to flow through multiple sets of tubes 158 (e.g., from the first section 160 to the second section 162) in parallel with one another. The working fluid flows may combine (e.g., within the second manifold 174) before flowing through the outlet 156. Although the inlet 154 and the outlet 156 are positioned at different sections 160, 162 in the illustrated embodiment, additionally or alternatively, the inlet 154 and the outlet 156 may be positioned at the same section (e.g., at the first section 160, at the second section 162) of the heat exchanger 150. In this manner, the working fluid may enter and exit the heat exchanger 150 at the same section.

In additional or alternative embodiments, the first tube portions 158A may be fluidly separate from the second tube portions 158B. That is, each tube 158 may extend along one of the dimensions 176, 178 and not along the other of the dimensions 176, 178. Thus, working fluid may flow through one of the sections 160, 162 and not the other of the sections 160, 162. For example, each of the sections 160, 162 may receive a separate working fluid flow, such as from separate vapor compression systems, and each section 160, 162 may separately discharge the working fluid flow. To this end, each of the sections 160, 162 may include a dedicated or separate inlet 154 and outlet 156 for the respective tube portions 158A, 158B.

The heat exchanger 150 may include an intermediate section or a transition region 180 extending between the first section 160 and the second section 162. For example, the first section 160 and the second section 162 may interface with one another at the intermediate section 180. In some embodiments, such as embodiments in which each tube 158 extends from the first manifold 172 to the second manifold 174, each tube 158 may include a bend 182 to form the first tube portion 158A and the second tube portion 158B. The bend 182 may be disposed in the intermediate section 180. Thus, the first section 160 and the second section 162 may transition between one another at the intermediate section 180. In additional or alternative embodiments, such as embodiments in which each tube portion 158A, 158B is fluidly separate from one another, the first tube portion 158A and the second tube portion 158B may be coupled to one another at the intermediate section 180. For example, the tubes 158 of the first section 160 and the tubes 158 of the second section 162 may be separate components that are coupled to one another at the intermediate section 180 to form the first tube portion 158A and the second tube portion 158B. In any case, the first tube portion 158A may extend from the first manifold 172 to the intermediate section 180, and the second tube portion 158B may extend from the second manifold 174 to the intermediate section 180.

In some embodiments, the air flow 153 may be directed in a direction along (e.g., generally parallel to) a second axis 184 (e.g., a vertical axis), such as in a direction 186 crosswise (e.g., generally perpendicular) to a third axis 188 (e.g., a lateral axis), through the heat exchanger 150. Thus, the air flow 153 may be directed into the space 170 and through the second section 162 or through the first section 160. Additionally or alternatively, the air flow 153 may be directed in an opposite direction with respect to the direction 186 through the heat exchanger 150. Thus, the air flow 153 may be directed through the first section 160 or through the second section 162 and into the space 170. In further embodiments, the air flow 153 may be directed in a different direction, such as along the first axis 159, along the third axis 188, or in any direction therebetween.

The heat exchanger 150 may also include end sheets (e.g., end panels, cap sheets) to facilitate incorporation of additional components. For example, the first section 160 may include a first end sheet 190, and the second section 162 may include a second end sheet 192. As further described herein, the end sheets 190, 192 may be configured to couple to another component, such as a plate, thereby attaching the component to the sections 160, 162 of the heat exchanger 150. For instance, the first end sheet 190 may include first flanges 194, and the second end sheet 192 may include second flanges 196. Each of the first flanges 194 may include a first opening or hole 198, and each of the second flanges 196 may include a second opening or hole 200. A component (e.g., an end plate, a side plate, a delta plate) may be configured to engage with the first flanges 194 and the second flanges 196, and fasteners may be inserted through the component and the first flanges 194 via the first openings 198 and/or through the component and the second flanges 196 via the second openings 200 to secure the component onto the end sheets 190, 192. In additional or alternative embodiments, the first end sheet 190 and/or the second end sheet 192 may be coupled to another component using other features, such as a weld, an adhesive, a punch, and the like, which may be arranged on the flanges 194, 196.

The end sheets 190, 192 may be positioned at a first side 206 (e.g., a front side) of the heat exchanger 150 to enable the component to couple to the first side 206 of the heat exchanger 150. The first side 206 may extend crosswise with respect to a second side 208 (e.g., a bottom side, an underside, a first end) and a third side 210 (e.g., a top side, a second end) of the heat exchanger 150. The first surface 202 of the first end sheet 190 may be generally planar with a second surface 204 of the second end sheet 192 along the first side 206 to enable the component to engage each of the first end sheet 190 (e.g., the first flanges 194) and the second end sheet 192 (e.g., the second flanges 196) at the first side 206 and extend crosswise to the second side 208 and the third side 210. In the illustrated embodiment, the manifolds 172, 174 are disposed at and extend along (e.g., along the first axis 159) the second side 208, and the intermediate section 180 is disposed at and extends along (e.g., along the first axis 159) the third side 210. However, in additional or alternative embodiments, the manifolds 172, 174 may be disposed at the third side 210, and the intermediate section 180 may be disposed at the second side 208.

Figure 6:
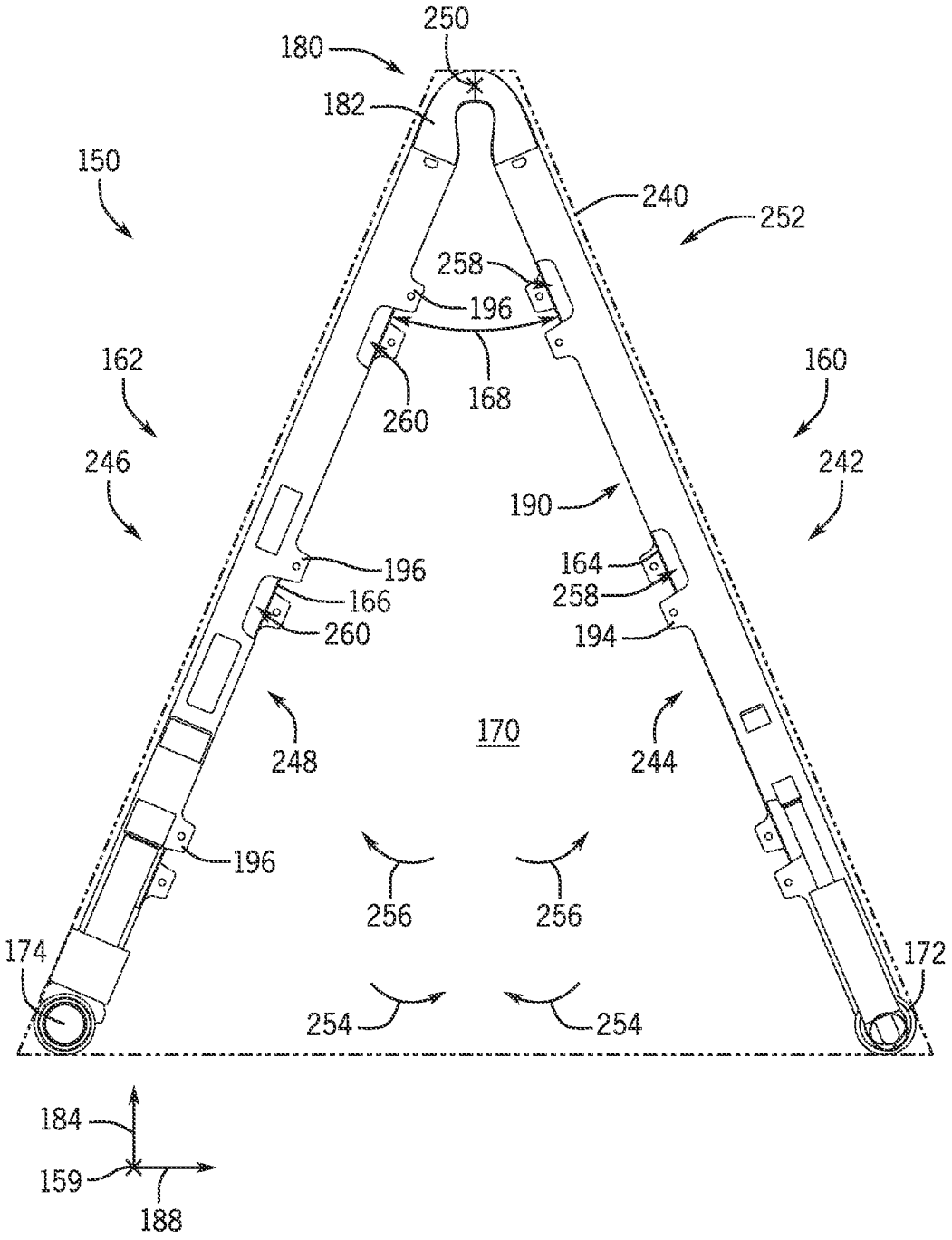
FIG. 6 is a front view of an embodiment of a heat exchanger for an HVAC system, in accordance with an aspect of the present disclosure.

FIG. 6 is a front view of an embodiment of the heat exchanger 150. In the illustrated embodiment, the sections 160, 162 are oriented crosswise with respect to one another, the second axis 184, and the third axis 188. Additionally, the first flanges 194 of the first end sheet 190 and the second flanges 196 of the second end sheet 192 may extend generally toward one another. That is, the first flanges 194 may extend toward the second section 162 (e.g., at least partially along the third axis 188), and the second flanges 196 may extend toward the first section 160 (e.g., at least partially along the third axis 188). In this manner, the flanges 194, 196 may extend inwardly or in a direction (e.g., along the third axis 188) toward the space 170 between the first section 160 and the second section 162. Such orientation of the flanges 194, 196 may limit (e.g., do not increase) a physical footprint or volume occupied by the heat exchanger 150. For example, the heat exchanger 150 may be confined within an outer boundary 240 defined by a perimeter of the heat exchanger 150 viewed along the first axis 159. The outer boundary 240 extends along a first exterior side 242 (e.g., opposite a first interior side 244 facing the space 170) of the first section 160, along a second exterior side 246 of the second section 162 (e.g., opposite a second interior side 248 facing the space 170), across the intermediate section 180, and across the manifolds 172, 174. The flanges 194, 196 extend inwardly (e.g., from the interior sides 244, 248) and toward an interior defined by the outer boundary 240. As such, the flanges 194, 196 do not increase a size or dimension of the outer boundary 240 and the physical footprint or volume occupied by the heat exchanger 150.

In certain embodiments, the first section 160 and the second section 162 may be configured to move relative to one another. By way of example, the first section 160 and the second section 162 may rotate or pivot relative to one another about the intermediate section 180. For instance, the bend 182 may define a rotational axis 250 that extends in a direction along the first axis 159. The first tube portion 158A and the second tube portion 158B may rotate relative to one another about the rotational axis 250 to rotate the first section 160 and the second section 162 relative to one another.

As an example, FIG. 6 illustrates the heat exchanger 150 in an expanded configuration 252 in which the first section 160 and the second section 162 may extend crosswise relative to one another (e.g., at the angle 168) to form the space 170. The heat exchanger 150 may be installed in the HVAC system 152 in the expanded configuration 252 to facilitate greater heat transfer between the heat exchanger 150 and the air flow 153 during operation of the HVAC system 150. For example, the crosswise orientation of the first section 160 and the second section 162 in the expanded configuration 252 may enable increased heat transfer between the first tube portion 158A and the air flow 153 and between the second tube portion 158B and the air flow 153, such as via heat transfer between the tubes 158 and the air flow 153 within the space 170. The first section 160 and the second section 162 may also rotate in inward directions 254 toward one another to reduce a magnitude of the angle 168, the size of the space 170, and the size or dimensions of the outer boundary 240. Reducing the size of the outer boundary 240 may reduce the physical footprint or volume occupied by the heat exchanger 150 and enable more efficient usage of the space in which the heat exchanger 150 is disposed. Indeed, as further described herein, the sections 160, 162 may be rotated in inward directions 254 to transition the heat exchanger 150 from the expanded configuration 252 to a compact configuration in which the sections 160, 162 may extend along and/or engage one another. For instance, the heat exchanger 150 may be more easily stored and/or transported in the compact configuration, such as for delivery, maintenance, service, or other operations in which the heat exchanger 150 may not be installed in the HVAC system 152.

The sections 160, 162 may also be rotated in outward directions 256 away from one another to transition the heat exchanger 150 from the compact configuration to the illustrated expanded configuration 252. Rotation of the sections 160, 162 in the outward directions 256 may increase a magnitude of the angle 168, the space 170, and the size or dimensions of the outer boundary 240. For example, the sections 160, 162 may be rotated in the outward directions 256 prior to installation of the heat exchanger 150 within the HVAC system 152. In some embodiments, the heat exchanger 150 may also be adjusted to an intermediate configuration (e.g., a partially expanded configuration, a partially compact configuration) between the expanded configuration 252 and the compact configuration. As an example, the heat exchanger 150 may be adjusted to the intermediate configuration to facilitate installation of the heat exchanger 150 in the HVAC system 152, such as to accommodate various tolerances, dimensions, and/or structural boundaries that may be imposed by a structure or component of the HVAC system 152 within which the heat exchanger 150 is positioned. Thus, adjustability of the sections 160, 162 may increase flexibility associated with usage of the heat exchanger 150.

In certain embodiments, the sections 160, 162 may be movable relative to one another via a manual force imparted (e.g., by an operator, by a technician) onto the first section 160 and/or the second section 162. Indeed, the heat exchanger 150 may be adjustable between various configurations without usage of an additional tool or device dedicated to moving the sections 160, 162 relative to one another. For example, the manual force may be imparted to move the sections 160, 162 (e.g., via elastic deformation) in the inward directions 254 to transition the heat exchanger 150 to the compact configuration. Furthermore, a lack of manual force being imparted on the sections 160, 162 may cause the sections 160, 162 to move in the outward directions 254 (e.g., due to elastic deformation, a spring force of the tubes 158) to transition the heat exchanger 150 to the expanded configuration 252.

As an example, the heat exchanger 150 may be arranged to enable the manual force to rotate the sections 160, 162 via the bend 182. For instance, each tube 158 may have a certain dimension (e.g., a thickness), each tube 158 may be bent, flexed, and/or twisted to form the bend 182 having a particular geometry, and/or each tube 158 may be formed from a material (e.g., a metal) to enable the sections 160, 162 to rotate via a manual force and transition the heat exchanger 150 between various configurations without deforming (e.g., plastically deforming, permanently deforming) the tubes 158. Furthermore, the heat exchanger 150 (e.g., the tubes 158) may be arranged to block excessive rotation of the sections 160, 162 in the outward directions 256. For example, the sections 160, 162 may be blocked from rotating and forming the angle 168 with a magnitude that is greater than a threshold angle during an absence of the manual force imparted onto the first section 160 and/or the second section 162. Indeed, when no manual force is imparted onto the sections 160, 162, the heat exchanger 150 may transition to the expanded configuration 252 (e.g., a resting configuration) in which the first section 160 and the second section 162 are oriented in at the angle 168 having a desired magnitude in which the heat exchanger 150 may be installed in the HVAC system 152 and operating to transfer heat between the air flow 153 and a working fluid.

First notches 258 (e.g., cutouts) may be formed in the first end sheet 190, and second notches 260 (e.g., cutouts) may be formed in the second end sheet 192. Each first notch 258 may be configured to receive a corresponding second flange 196 of the second end sheet 192 in the compact configuration of the heat exchanger 150, and each second notch 260 may be configured to receive a corresponding first flange 194 of the first end sheet 190 in the compact configuration. The first notches 258 and the second notches 260 may enable increased rotation of the sections 160, 162 in the inward directions 254 to cause the first flanges 194 to overlap with the second section 162 and the second flanges 196 to overlap with the first section 160. In other words, the first notches 258 may block the second flanges 196 from contacting the first end sheet 190, and the second notches 260 may block the first flanges 194 from contacting the second end sheet 192 during transition of the heat exchanger 150 to the compact configuration. For this reason, the notches 258, 260 may enable rotation of the sections 160, 162 in the inward directions 254 until the first edge 164 of the first section 160 and the second edge 166 of the second section 162 engage with one another, rather than, for example, until the first flanges 194 engage with the second end sheet 192 and/or the second notches 260 engage with the first end sheet 190.

Figure 7:
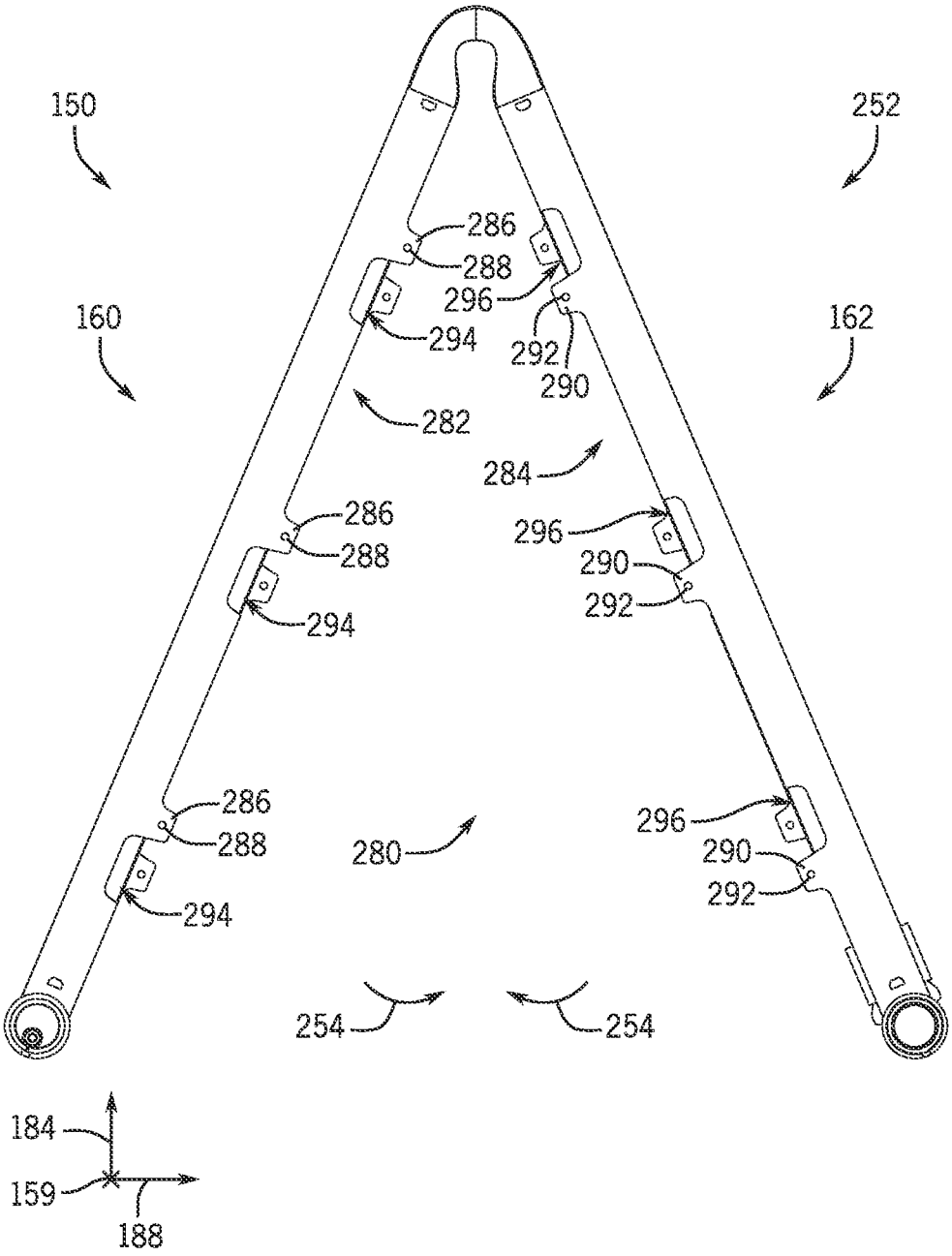
FIG. 7 is a rear view of an embodiment of a heat exchanger for an HVAC system, in accordance with an aspect of the present disclosure.

FIG. 7 is a rear view of an embodiment of the heat exchanger 150 in the expanded configuration 252. The heat exchanger 150 may have end sheets positioned at a fourth side 280 (e.g., a rear side), opposite the first side 206, of the heat exchanger 150. For example, the first section 160 may include a third end sheet 282 coupled at the fourth side 280, and the second section 162 may include a fourth end sheet 284 coupled at the fourth side 280. The third end sheet 282 and the fourth end sheet 284 may also enable coupling of another component (e.g., a plate) to the first section 160 and the second section 162 at the fourth side 280. For example, the third end sheet 282 may include third flanges 286 that have third openings or holes 288, and the fourth end sheet 284 may include fourth flanges 290 that have fourth openings or holes 292. The third end sheet 282 (e.g., the third flanges 286) and the fourth end sheet 284 (e.g., the fourth flanges 290) may be configured to engage with the component. Fasteners may be inserted through the component and the third flanges 286 via the third openings 288 and/or through the component and the fourth flanges 290 via the fourth openings 292 to secure the component onto the third end sheet 282 and the fourth end sheet 284.

Notches may also be formed into the third end sheet 282 and the fourth end sheet 284 to enable receipt of a corresponding one of the third flanges 288 or the fourth flanges 290 in the compact configuration of the heat exchanger 150. For example, third notches 294 may be formed in the third end sheet 282, and each third notch 294 may be configured to receive one of the fourth flanges 290 of the fourth end sheet 284 in the compact configuration. Furthermore, fourth notches 296 may be formed in the fourth end sheet 284, and each fourth notch 296 may be configured to receive one of the third flanges 288 of the third end sheet 282 in the compact configuration. In this manner, abutment between the third flanges 288 and the fourth end sheet 284 may be avoided, and abutment between the fourth flanges 290 and the third end sheet 282 may be avoided, thereby enabling increased rotation of the sections 160, 162 in the inward directions 254. For example, the third flanges 288 may overlap with the second section 162 along the third axis 188 and the fourth flanges 290 may overlap with the first section 160 along the third axis 188 in the compact configuration.

Figure 8:
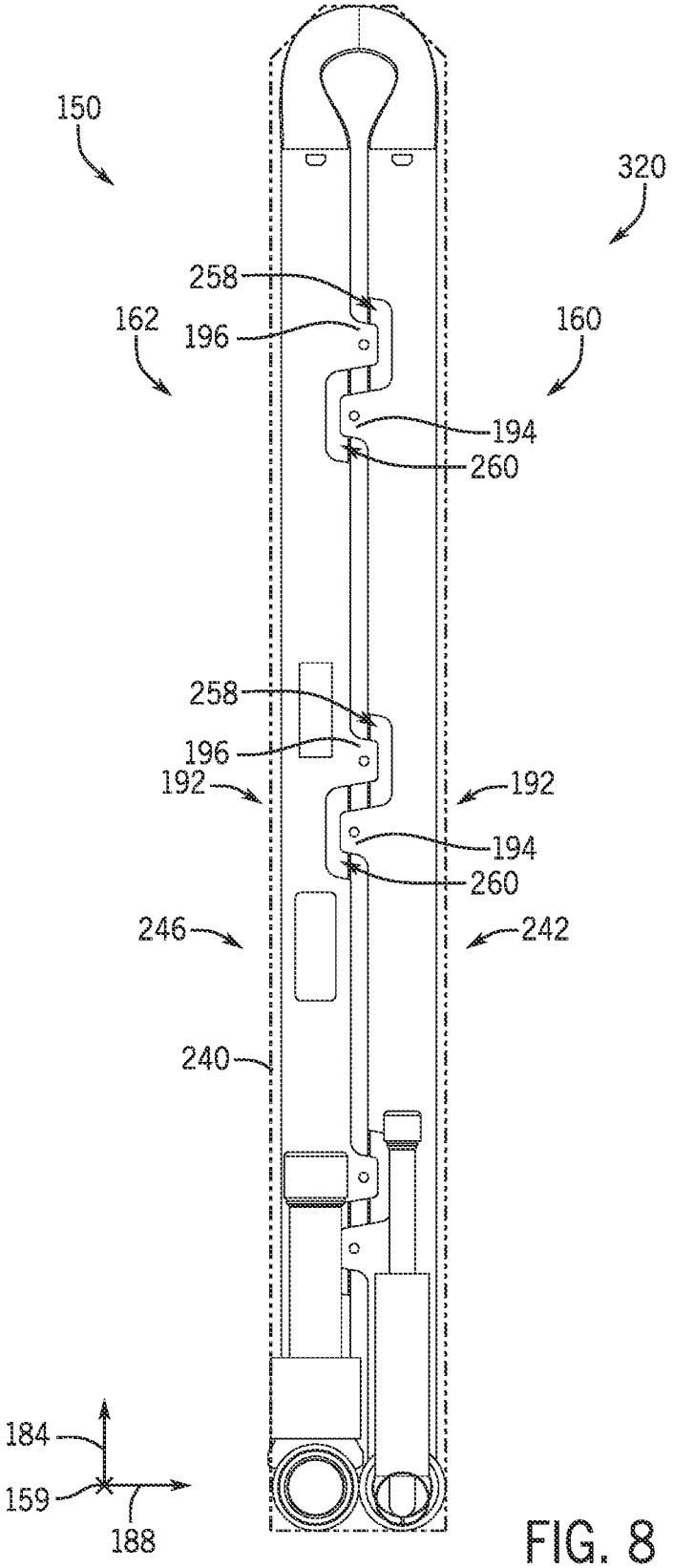
FIG. 8 is a front view of an embodiment of a heat exchanger for an HVAC system, illustrating the heat exchanger in a compact configuration, in accordance with an aspect of the present disclosure.

FIG. 8 is a front view of an embodiment of the heat exchanger 150 in a compact configuration 320. In the compact configuration 320, the first section 160 and the second section 162 may be engaged with one another and/or extend along one another (e.g., along the second axis 184). Thus, the outer boundary 240 defined by the perimeter of the heat exchanger 150 in the compact configuration 320 may be less than (e.g., substantially less than, smaller than) the outer boundary 240 associated with the heat exchanger 150 in the expanded configuration 252. As such, the heat exchanger 150 may occupy a reduced physical footprint (e.g., a reduced volume of space) in the compact configuration 320. The compact configuration 320 of the heat exchanger 150 may enable more efficient usage of space. For instance, the heat exchanger 150 may be more easily moved and/or stored, such as to accommodate positioning of other objects within a confined space (e.g., during storage or transportation of the heat exchanger 150).

In the compact configuration, the first flanges 194 of the first end sheet 190 may be positioned within corresponding second notches 260 formed in the second end sheet 192 and may overlap with the second section 160 along the third axis 188. Additionally, the second flanges 196 of the second end sheet 192 may be positioned within corresponding first notches 258 of the first end sheet 190 and may overlap with the first section 160 along the third axis 188. Such positioning of the flanges 194, 196 in the notches 258, 260 may enable increased movement of the sections 160, 162 to engage with or extend along one another in the compact configuration 320. Thus, the inward extension of the flanges 194, 196 may limit (e.g., may not increase) the size of the outer boundary 240 associated with the compact configuration 320 of the heat exchanger 150. Moreover, the inward extension of the flanges 194, 196 may shield the flanges 194, 196 from certain external elements. For instance, contact between the flanges 194, 196 and objects that are positioned at the first exterior side 242 of the first section 160 and/or at the second exterior side 246 of the second section 162 may be avoided. As an example, the orientation of the flanges 194, 196 may enable the first exterior side 242 and/or the second exterior side 246 to have a flatter geometry, and the heat exchanger 150 may be positioned against (e.g., flush with) another object, such as another heat exchanger 150, a wall, a panel, and so forth, at the first exterior side 242 and/or at the second exterior side 246. Thus, the spatial positioning of the heat exchanger 150 with respect to an adjacent object may be more efficient. As another example, the orientation of the flanges 194, 196 may enable the heat exchanger 150 to be moved (e.g., in the compact configuration 320) without causing contact between the flanges 194, 196 and another object, such as a user, an enclosure, another component of the HVAC system 152, and so forth. As such, a structural integrity, a geometry, and/or a useful lifespan of the flanges 194, 196 may be increased.

In the illustrated embodiment, a first flange 194 may be positioned adjacent to a corresponding one of the second flanges 196 in the compact configuration 320. However, in additional or alternative embodiments, the first flanges 194 and the second flanges 196 may be arranged such that the first flanges 194 are positioned further apart from the second flanges 196 in the compact configuration 320. In other words, there may be a greater offset distance between a first flange 194 and an adjacent second flange 196 along the second axis 184.

Figure 9:
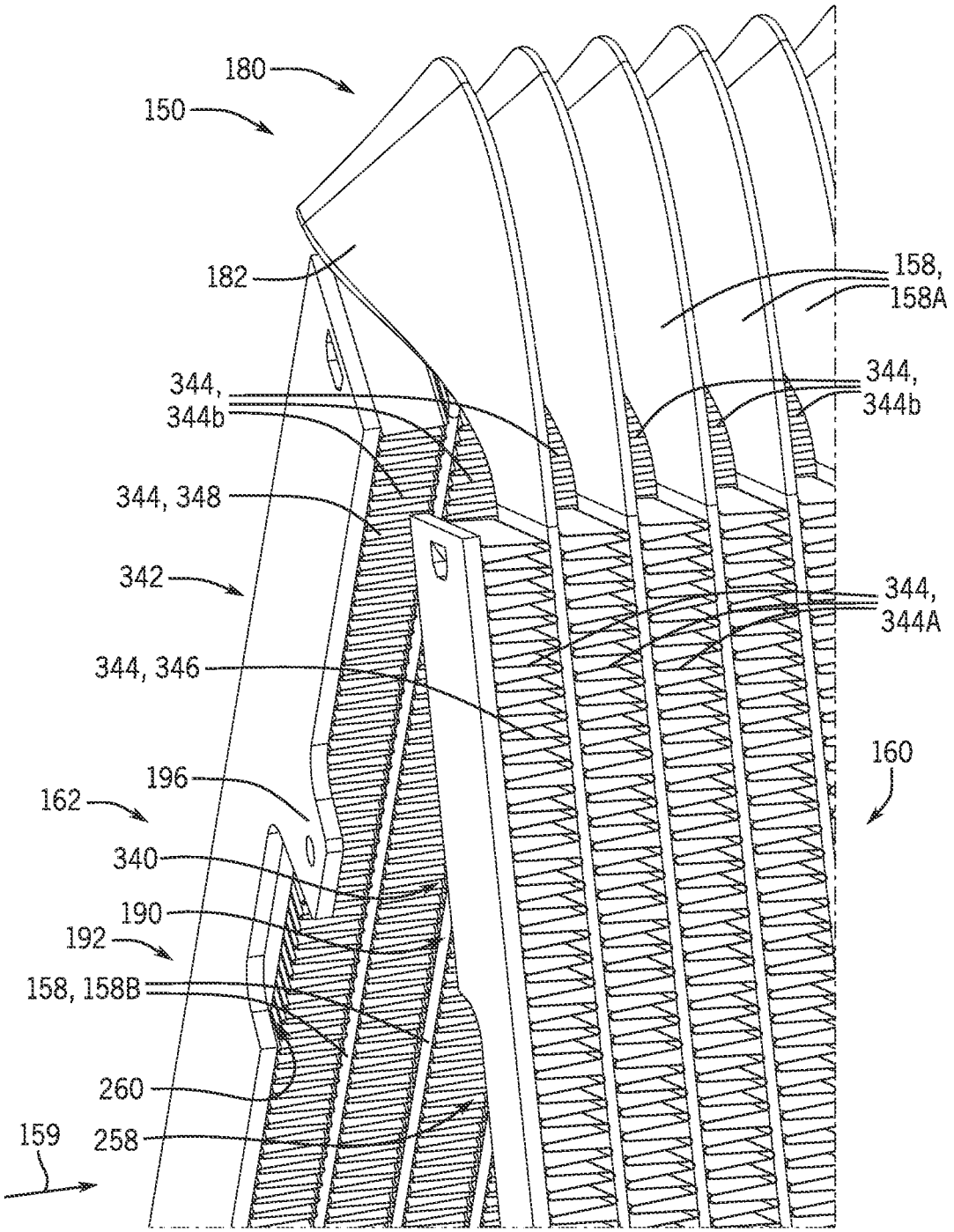
FIG. 9 is a detailed perspective view of an embodiment of a heat exchanger for an HVAC system, in accordance with an aspect of the present disclosure.

FIG. 9 is a detailed perspective view of an embodiment of the heat exchanger 150. In the illustrated embodiment, the first end sheet 190 is coupled to and extends along a first end 340 of the first section 160. For example, the first end sheet 190 may extend along the first tube portions 158A of the first section 160. Additionally, the second end sheet 192 is coupled to and extends along a second end 342 of the second section 162, such as along the second tube portions 158B of the second section 162. As described above, the working fluid may flow through the first tube portions 158A and through the second tube portions 158B, such as between the tube portions 158 via the intermediate section 180 (e.g., via the bend 182). Thus, the first end sheet 190 may extend along a direction of the flow of working fluid through the first tube portions 158A at the first section 160, and the second end sheet 192 may extend along a direction of the flow of working fluid through the second tube portions 158B at the second section 162.

Additionally, the heat exchanger 150 may include fins 344 that are coupled to the tubes or tube portions 158 (e.g., microchannel tubes). First fins 344A may be coupled to the first tube portions 158A, and second fins 344B may be coupled to the second tube portions 158B. For instance, the first fins 344A may span between adjacent first tube portions 158A to couple the adjacent first tube portions 158A to one another, and the second fins 344B may span between adjacent second tube portions 158B to couple the adjacent second tube portions 158B to one another. The fins 344 may increase an efficiency of the operation of the heat exchanger 150 to transfer heat between the working fluid flowing through the tubes 158 and the air flow 153 directed across the tubes 158. For example, the fins 344 may increase heat transfer by absorbing additional heat from the working fluid or from the air flow 153. Thus, heat transfer between the working fluid and the air flow 153 may be enabled via the tubes 158 and via the fins 344. In the illustrated embodiment, the fins 344 have a wave or zigzag shaped profile, but the fins 344 may have any suitable profile in additional or alternative embodiments.

In some embodiments, the first end sheet 190 may be coupled to or secured to one of the first fins 344A, such as a fin 346 that is positioned outermost (e.g., along the first axis 159) at the first end 340 of the first section 160. Additionally, the second end sheet 192 may be coupled to or secured to one of the second fins 344B, such as a fin 348 that is positioned outermost (e.g., along the first axis 159) at the second end 342 of the second section 162. By way of example, the first end sheet 190 and the second end sheet 192 may be coupled to the respective fins 344 via a weld, an adhesive, a fastener, a brazing technique, and so forth. Furthermore, the first notches 258 formed in the first end sheet 190 may expose the fin 346 at the first end 340, and the second notches 260 formed in the second end sheet 192 may expose the fin 348 at the second end 342. In certain embodiments, in the compact configuration 320, the first flanges 194 of the first end sheet 190 may extend into the corresponding second notches 260 of the second end sheet 192 and engage with (e.g., abut against) the fin 348, and the second flanges 196 of the second end sheet 192 may extend into the corresponding first notches 258 of the first end sheet 190 and engage with (e.g., abut against) the fin 346. In additional or alternative embodiments, the first flanges 194 may overlap with the fin 348 without contacting the fin 348, and the second flanges 196 may overlap with the find 346 without contacting the fin 346 in the compact configuration 320. In further embodiments, the first end sheet 190 may be coupled to one of the first tube portions 158A (e.g., a first tube portion 158A positioned outermost along the first axis 159 at the first end 340), and/or the second end sheet 192 may be coupled to one of the second tube portions 158B (e.g., a second tube portion 158B positioned outermost along the first axis 159 at the second end 342). In such embodiments, the first flanges 194 may overlap with and/or engage with one of the second tube portions 158B (e.g., by extending into the corresponding second notches 260), and/or the second flanges 196 may overlap with and/or engage with one of the first tube portions 158A (e.g., by extending into the corresponding first notches 258).

The third end sheet 282 may similarly be coupled to the first section 160, and the fourth end sheet 284 may similarly be coupled to the second section 162 in the manner illustrated in FIG. 9 with respect to the first end sheet 190 and the second end sheet 192. That is, the third end sheet 282 may be coupled to one of the first fins 344A, and the fourth end sheet 284 may be coupled to one of the second fins 344B. In this manner, the third end sheet 282 may extend along the flow of working fluid through the first tube portions 158A at the first section 160, and the fourth end sheet 284 may extend along the flow of working fluid through the second tube portions 158B at the second section 162. Additionally, in the compact configuration 320, the third flanges 286 of the third end sheet 282 may be configured to abut one of the second fins 344B to which the fourth end sheet 284 is coupled, and the fourth flanges 290 of the fourth end sheet 284 may be configured to abut one of the first fins 344A to which the third end sheet 282 is coupled.

Figure 10:
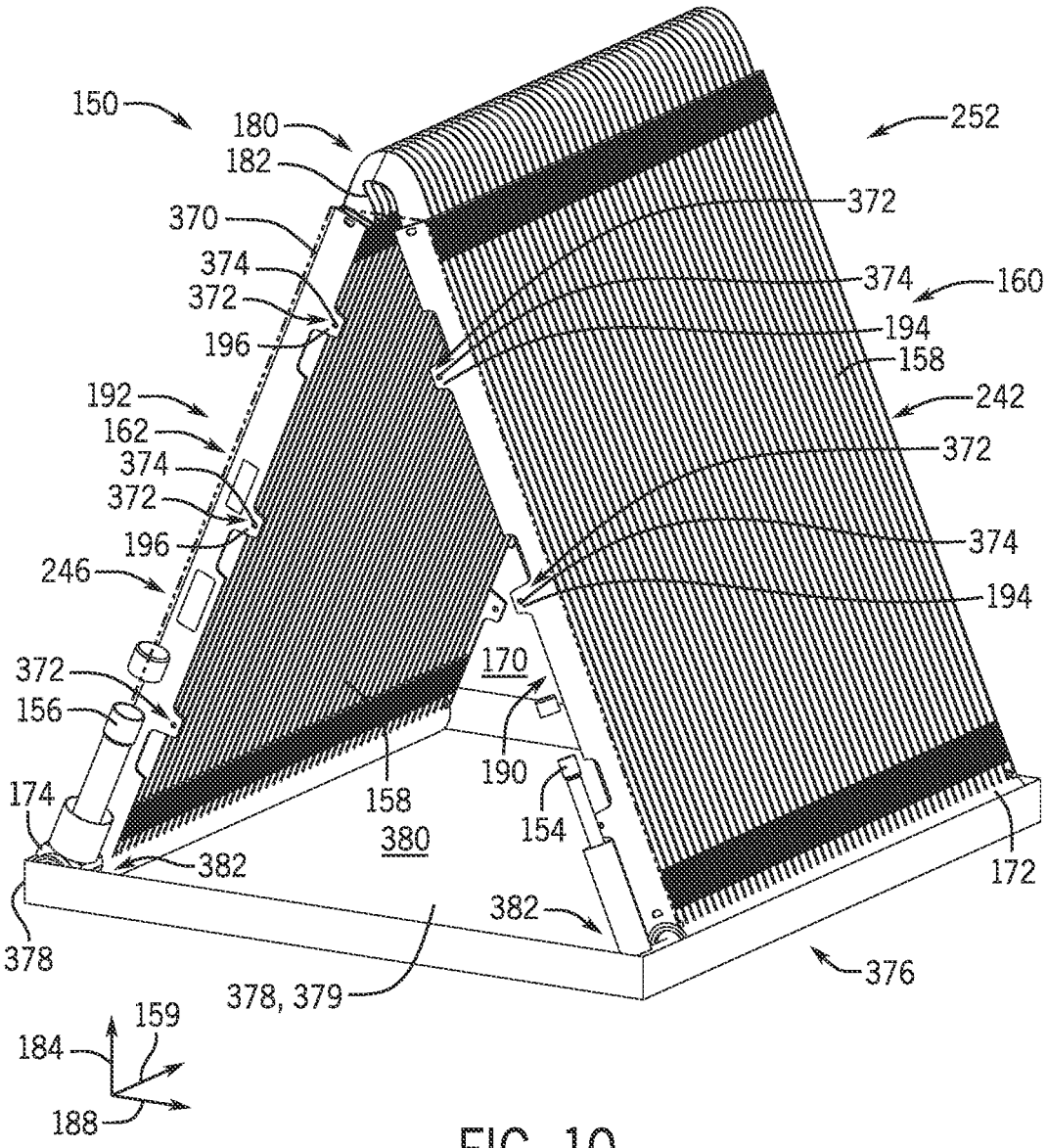
FIG. 10 is a perspective view of an embodiment of a heat exchanger for an HVAC system, in accordance with an aspect of the present disclosure.

FIG. 10 is a perspective view of an embodiment of the heat exchanger 150. A plate 370 (e.g., a delta plate, sheet metal), shown in phantom lines in FIG. 10, may be coupled to the heat exchanger 150 via the first end sheet 190 and the second end sheet 192. For example, the plate 370 may be positioned between the inlet 154/outlet 156 and the end sheets 190, 192 along the first axis 159. The plate 370 may be placed in engagement with the first surface 202 of the first end sheet 190 and the second surface 204 of the second end sheet 192 and therefore extend from the first section 160 to the second section 162 to occlude (e.g., partially enclose) the space 170 formed between the first section 160 and the second section 162 of the heat exchanger 150. Thus, the plate 370 may block the air flow 153 out of the space 170 along the first axis 159 and force the air flow 153 across the tubes 158. As such, the plate 370 may increase contact between the tubes 158 and the air flow 153, thereby increasing efficiency of the heat exchanger 150.

The plate 370 may include openings or holes 372 that may align with the first openings 198 of the first flanges 194 of the first end sheet 190 and the second openings 200 of the second flanges 196 of the second end sheet 192. The heat exchanger 150 may include fasteners 374 that are configured to extend through the openings 372 of the plate 370 that are aligned with the first openings 198 of the first end sheet 190 and/or through the openings 372 of the plate 370 that are aligned with the second openings 200 of the second end sheet 192. The fasteners 374 may secure the plate 370 onto the flanges 194, 196. For example, the fasteners 374 may include self-tapping screws that may bias the plate 370 against the end sheets 190, 192 via the flanges 194, 196 without having to access the space 170 between the first section 160 and the second section 162 (e.g., to position a nut through which the fasteners 374 may be inserted). Additionally or alternatively, any other suitable feature or components, such as another type of fastener 374, a weld, an adhesive, a punch, and so forth, may be used to couple the plate 370 to the end sheets 190, 192.

The plate 370 may be configured to mount to a drain pan 376. By way of example, the drain pan 376 may include walls 378 that define an internal volume 380 of the drain pan 376, and the plate 370 may extend into the internal volume 380 and engage with a base 379 of the walls 378. Mounting the plate 370 and the drain pan 376 onto one another may cause the heat exchanger 150 (e.g., the first section 160, the second section 162) to be at least partially disposed in the drain pan 376, such as in an installed configuration of the heat exchanger 150. For instance, the manifolds 172, 174 and/or the tubing 158 may be positioned within the internal volume 380 of the drain pan 376 and may also engage with the base 379 of the drain pan 376. The drain pan 376 may improve operation of the HVAC system 152, such as of the heat exchanger 150. As an example, operation of the heat exchanger 150 may generate condensate on the heat exchanger 150, such as on the tubes 158, the inlet 154, the outlet 156, the manifolds 172, 174, and so forth. The drain pan 376 may receive the condensate generated on the heat exchanger 150, such as via a gravitational force, and the drain pan 376 may direct the condensate away from the heat exchanger 150. Thus, the drain pan 376 may block the condensate from affecting a performance of the heat exchanger 150 to increase a heat transfer efficiency of the heat exchanger 150. Although the illustrated drain pan 376 has a rectangular shape, the drain pan 376 may have any suitable shape configured to receive condensate generated on the heat exchanger 150.

In some embodiments, the plate 370 may have a shape or profile that extends along (e.g., corresponds with, matches) the outer boundary 240 associated with the heat exchanger 150 in the expanded configuration 252. As an example, the plate 370 may not extend past (e.g., may be aligned with, may be flush with) the exterior sides 242, 246 of the heat exchanger 150. Therefore, a reduced amount of material may be used to manufacture the plate 370 as compared to a plate 370 that extends beyond the exterior sides 242, 246 (e.g., to enable interfacing with end sheets having flanges that extend outwardly away from the space 170). For this reason, a cost, a duration of time, and/or a difficulty associated with manufacture of the plate 370 may be reduced. Furthermore, the plate 370 may extend along (e.g., correspond with, match) a profile of the manifolds 172, 174 to accommodate the positioning of the inlet 154 and the outlet 156. That is, the plate 370 may have respective recesses 382 (e.g., formed at corners of the plate 370) that may be configured to receive the inlet 154 and the outlet 156 while the plate 370 is coupled to the heat exchanger 150 in an assembled configuration of the heat exchanger 150. Further still, the plate 370 may extend along the end sheets 190, 192 from the manifolds 172, 174 toward the intermediate section 180 to occlude the space 170. However, the plate 370 may not extend past where the bend 182 initiates to avoid contact with the bend 182. Thus, the plate 370 may be positioned in greater engagement with (e.g., more flush with) the end sheets 190, 192 for better securement to the end sheets 190, 192, and the plate 370 may avoid affecting rotation between the sections 160, 162. As such, the plate 370 may accommodate the features of the heat exchanger 150 without extending beyond the outer boundary 240 defined by the sections 160, 162. Thus, the plate 370 may enable the heat exchanger 150 to occupy a limited physical footprint.

In certain embodiments, another plate similar to the plate 370 may be configured to couple to the third end sheet 282 and the fourth end sheet 284 using similar techniques. That is, the plate may have a profile that is contained within the outer boundary 240 and accommodates various features (e.g., the manifolds 172, 174, the bend 182) of the heat exchanger 182. The plate may be configured to engage with the third flanges 286 of the third end sheet 282 and the fourth flanges 290 of the fourth end sheet 284, and the plate may have openings that align with the third openings 288 of the third end sheet 282 and/or the fourth openings 292 of the fourth end sheet 284. Fasteners may be inserted through the openings of the plate that are aligned with the third openings 288 and/or the fourth openings 292 to bias the plate against the end sheets 282, 284. The plate may further occlude the space 170 to increase efficiency of the heat exchanger 150, and the plate may also be configured to mount to the drain pan 376 to facilitate positioning of the first section 160 and the second section 162 within the drain pan 376.

Although each end sheet 190, 192, 282, 284 illustrated in FIGS. 5-10 includes three flanges and three notches, each end sheet 190, 192, 282, 284 may have any suitable number of flanges and notches in additional or alternative embodiments. For example, one of the end sheets 190, 192, 282, 284 may have one flange, two flanges, or more than three flanges to facilitate coupling with a plate (e.g., the plate 370). In such embodiments, another one of the end sheets 190, 192, 282, 284 may have a corresponding number of notches (e.g., the first notches 258, the second notches 260, the third notches 294, the fourth notches 296) configured to receive the flanges in the compact configuration 320 of the heat exchanger 150.

The present disclosure may provide one or more technical effects useful in the operation of an HVAC system. For example, the HVAC system may include a heat exchanger with tubes through which a working fluid may flow. The HVAC system may also direct an air flow across the tubes of the heat exchanger, and the heat exchanger may place the air flow in a heat exchange relationship with the working fluid to condition the air flow. In some embodiments, the tubes may define a first section and a second section of the heat exchanger, and the first section and the second section may be oriented to form a space extending therebetween. The heat exchanger may include a first end sheet coupled at the first section and extending along a flow of working fluid through the tubes at the first section, as well as a second end sheet coupled at the second section and extending along a flow of working fluid through the tubes at the second section. The first end sheet may include first flanges that extend toward the second end sheet, and the second end sheet may include second flanges that extend toward the first end sheet. In this manner, the orientation of the flanges may limit an outer boundary defined by the heat exchanger and may therefore limit a physical footprint occupied by the heat exchanger. The flanges may facilitate coupling of a plate onto the end sheets. By way of example, the plate may be placed in engagement with the flanges, and fasteners may be inserted through the plate and the flanges to bias the plate against the end sheets and secure the plate onto the sections of the heat exchanger. The plate may occlude the space formed between the first section and the second section and block undesirable flow of air out from the space. As such, usage of the plate may force air to flow across the heat exchanger tubes. In this manner, the flanges may improve a performance (e.g., an efficiency) associated with the heat exchanger.

In certain embodiments, the sections of the heat exchanger may be movable relative to one another. For instance, the sections may be rotated toward one another to move the flanges toward an opposing end sheet and further reduce a physical footprint occupied by the heat exchanger. For this reason, the first end sheet may include notches configured to receive the second flanges of the second end sheet, and the second end sheet may include notches configured to receive the first flanges of the first end sheet. The notches may enable the first flanges to overlap with the second end sheet and the second flanges to overlap with the first end sheet, thereby blocking contact between the first flanges and the second end sheet and/or between the second flanges and the first end sheet that may otherwise block movement of the sections toward one another. As such, the notches may enable a desirable range of motion between the sections of the heat exchanger, such as to enable the first section and the second section to engage with and/or extend along one another and reduce the physical footprint associated with the heat exchanger below a threshold size. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat exchanger for a heating, ventilation, and/or air conditioning (HVAC) system, comprising:

a plurality of tubes configured to direct a working fluid therethrough, wherein the plurality of tubes defines a first section and a second section of the heat exchanger, and the first section and the second section extend crosswise relative to one another; and an end sheet coupled to an end of the first section, wherein the end sheet comprises a plurality of flanges extending toward the second section, wherein the heat exchanger is configured to transition between an expanded configuration and a compact configuration, the first section and the second section extend crosswise relative to one another in the expanded configuration, the first section and the second section extend along one another in the compact configuration, and the plurality of flanges overlaps with the second section in the compact configuration of the heat exchanger.

2. The heat exchanger of claim 1, wherein the end sheet extends along the end of the first section and along a direction of working fluid flow through the plurality of tubes of the first section.

3. The heat exchanger of claim 1, wherein the end sheet is a first end sheet, the end is a first end, the plurality of flanges is a first plurality of flanges, the heat exchanger comprises a second end sheet coupled to a second end of the second section, and the second end sheet comprises a second plurality of flanges extending toward the first section.

4. The heat exchanger of claim 3, comprising a plate configured to be secured to the first plurality of flanges and the second plurality of flanges and extend from the first section to the second section.

5. The heat exchanger of claim 4, comprising a first fastener configured to extend through the plate and a first flange of the first plurality of flanges and a second fastener configured to extend through the plate and a second flange of the second plurality of flanges.

6. The heat exchanger of claim 1, wherein the end sheet is a first end sheet, the end is a first end, the plurality of flanges comprises a first flange, the heat exchanger comprises a second end sheet coupled to a second end of the second section, the second end sheet comprises a notch formed therein, and the notch is configured to receive the first flange in the compact configuration of the heat exchanger.

7. The heat exchanger of claim 1, wherein the first section comprises a first manifold configured to receive the working fluid and direct the working fluid into the plurality of tubes, and the second section comprises a second manifold configured to receive the working fluid from the plurality of tubes and discharge the working fluid from the heat exchanger.

8. The heat exchanger of claim 7, wherein each tube of the plurality of tubes extends from the first manifold to the second manifold, and each tube of the plurality of tubes comprises a bend formed between the first section and the second section.

9. The heat exchanger of claim 1, comprising a plurality of fins extending between the plurality of tubes, wherein the end sheet is coupled to a fin of the plurality of fins.

10. A heat exchanger for a heating, ventilation, and/or air conditioning (HVAC) system, comprising:

a plurality of tubes configured to direct a working fluid therethrough, wherein the plurality of tubes defines a first panel section, a second panel section, and an intermediate section extending between the first panel section and the second panel section, wherein the first panel section and the second panel section are configured to rotate relative to one another about the intermediate section, the first panel section and the second panel section are configured to rotate toward one another to transition the heat exchanger to a compact configuration, and the first panel section and the second panel section are configured to rotate away from one another to transition the heat exchanger to an expanded configuration;

a first end sheet coupled to the first panel section, wherein the first end sheet comprises a flange extending between the first panel section and the second panel section; and a second end sheet coupled to the second panel section, wherein the second end sheet comprises a notch formed therein, and the notch is configured to receive the flange of the first end sheet in the compact configuration of the heat exchanger.

11. The heat exchanger of claim 10, comprising a plurality of fins extending between the plurality of tubes, wherein the second end sheet is coupled to a fin of the plurality of fins, and the flange is configured to extend into the notch and engage with the fin in the compact configuration of the heat exchanger.

12. The heat exchanger of claim 10, wherein the plurality of tubes comprises microchannel tubes.

13. A heat exchanger for a heating, ventilation, and/or air conditioning (HVAC) system, comprising:

a plurality of tubes configured to direct a working fluid therethrough;

a first section comprising a first portion of the plurality of tubes, wherein the first section comprises a first end sheet extending along a first direction of working fluid flow through the first portion of the plurality of tubes, and the first end sheet comprises a first flange; and a second section comprising a second portion of the plurality of tubes, wherein the second section comprises a second end sheet extending along a second direction of working fluid flow through the second portion of the plurality of tubes, the second end sheet comprises a second flange, the first flange and the second flange extend toward one another, and the first flange is separate from the second flange, wherein the first section and the second section are configured to rotate toward one another to transition the heat exchanger to a compact configuration, the first section and the second section are configured to rotate away from one another to transition the heat exchanger to an expanded configuration, and the first flange overlaps with the second section in the compact configuration of the heat exchanger.

14. The heat exchanger of claim 13, comprising a plate configured to couple to the first end sheet via the first flange and to the second end sheet via the second flange, wherein the plate is configured to at least partially enclose a space formed between the first section and the second section.

15. The heat exchanger of claim 14, wherein the plate is configured to extend into a drain pan, and the first section and the second section are configured to be at least partially disposed in the drain pan in an installed configuration of the heat exchanger.

16. The heat exchanger of claim 13, wherein each tube of the plurality of tubes extends from the first section to the second section, each tube forms a bend between the first section and the second section, and the first section and the second section are configured to rotate relative to one another via the bend.

17. The heat exchanger of claim 1, wherein the heat exchanger is configured to transition from the expanded configuration to the compact configuration via application of a manual force to the first section, the second section, or both.

18. The heat exchanger of claim 1, wherein the plurality of tubes comprises microchannel tubes.

19. The heat exchanger of claim 10, wherein each tube of the plurality of tubes comprises a bend at least partially defining the intermediate section.

20. The heat exchanger of claim 13, wherein the plurality of tubes comprises microchannel tubes.

* * * * *